US008301328B2

(12) United States Patent
McAndrew et al.

(10) Patent No.: US 8,301,328 B2
(45) Date of Patent: Oct. 30, 2012

(54) METHOD FOR SERVICING A VEHICLE

(75) Inventors: Dennis William McAndrew, Waterford, PA (US); Adam Josef Oser, Millcreek, PA (US)

(73) Assignee: General Electric Company, Schenectady, NY (US)

( * ) Notice: Subject to any disclaimer, the term of this patent is extended or adjusted under 35 U.S.C. 154(b) by 1529 days.

(21) Appl. No.: 11/498,447

(22) Filed: Aug. 2, 2006

(65) Prior Publication Data

US 2007/0225881 A1 Sep. 27, 2007

Related U.S. Application Data

(60) Provisional application No. 60/785,225, filed on Mar. 22, 2006.

(51) Int. Cl.
*G01M 17/00* (2006.01)
*G06F 7/00* (2006.01)

(52) U.S. Cl. ..... 701/29.1; 701/29.4; 701/33.4; 701/34.4; 701/37; 701/99

(58) Field of Classification Search ..... 701/1, 9, 701/29, 33, 34, 37, 99; 123/540, 340; 73/146.3
See application file for complete search history.

(56) References Cited

U.S. PATENT DOCUMENTS 5,361,628 A * 11/1994 Marko et al. ..... 73/114.15
5,845,225 A * 12/1998 Mosher ..... 701/102
6,151,108 A * 11/2000 Kwon et al. ..... 356/70
6,732,025 B2 * 5/2004 Reese et al. ..... 701/29
6,782,317 B2 * 8/2004 Mitchell et al. ..... 701/100
6,810,718 B2 * 11/2004 Wilson et al. ..... 73/54.01
6,853,954 B2 * 2/2005 Apostolides ..... 702/182
7,204,128 B1 * 4/2007 Liu et al. ..... 73/53.01
7,450,235 B1 * 11/2008 Said et al. ..... 356/436
7,727,943 B2 * 6/2010 Brown et al. ..... 508/165
2002/0099482 A1 * 7/2002 Reese et al. ..... 701/29
2002/0185604 A1 * 12/2002 Coates et al. ..... 250/339.09
2002/0193921 A1 * 12/2002 Reese et al. ..... 701/29
2003/0095038 A1 * 5/2003 Dix ..... 340/425.5
2003/0146050 A1 * 8/2003 Dayal et al. ..... 184/1.5
2004/0059542 A1 * 3/2004 Apostolides ..... 702/182
2004/0176879 A1 * 9/2004 Menon et al. ..... 701/1
2004/0220716 A1 * 11/2004 Yokohata et al. ..... 701/102
2008/0206874 A1 * 8/2008 Manka ..... 436/2
2010/0173813 A1 * 7/2010 Brown et al. ..... 508/291
2010/0173814 A1 * 7/2010 Brown et al. ..... 508/291

OTHER PUBLICATIONS

EPA, Test and Quality Assurance Plan, 2004, Internet, pp. 1-57.*

* cited by examiner

*Primary Examiner* — Ian Jen
(74) *Attorney, Agent, or Firm* — GE Global Patent Operation; John A. Kramer

(57) ABSTRACT

A system and method for monitoring at least one characteristic of a vehicle is provided, wherein the method includes generating a data set that includes data responsive to the at least one characteristic. The method further includes comparing the data set against predetermined parametric data and creating trend data for a plurality of the data sets. Furthermore, the method includes analyzing the trend data to determine if action should be taken regarding the vehicle.

15 Claims, 10 Drawing Sheets

A

Most likely sources[1]:
* Main Bearings
  (ratio%: Cu/Pb/Sn)
* Connecting Rod Bearings
  (ratio%: Cu/Pb/Sn)
* Art Rod Pin Bushing
  (ratio %: Cu/Pb/Sn)
* Fuel Push Rod
  (ratio%: Cu/Pb/Sn)
*If wear is severe, Fe may also be present (comes from journals or bearing backing).

B

Most likely sources:
* New engine
* New oil cooler
* Valve rocker bushings[3]
* Piston pin bushings[3]
* Camshaft thrust bearings[3]
* Crankshaft thrust bearings[3]
* Lube oil pump bearings[3]
*Governor drive bushings[3]
[3]Sn may also be present

C

Most likely sources:
* Overlay on main, rod, or piston pin bearings

D

Most likely sources:
* Piston rings
* Cr Cylinder liner (where used)
* Repaired crank journals

E

Most likely sources:
* Cylinder liner
* Piston rings
* Cam and roller
* Valve stem and guides
* Crank or cam journals[2]
* Main or rod bearing backing[2]
[2]Cu and Pb should also be present

F

Most likely source is a cooling water leak into engine oil. Check the following:
* Intercooler
* Power assembly
* Oil cooler
* Water pump
If water is excessive, inspect main bearings for damage.
(where NaCr water treatment is used, Cr will also be present)

G

Most likely source other than cooling water leak into engine oil:
* Oil Additives

H

Most likely sources:
* Piston Skirts
* Cam bearings
* Free end cover bearings
* Alt end oil seal assembly
* Turbo rotors
* Dirt ingress (usually accompanied by silicon)

I

Most likely source other than cooling water leak into engine oil:
* Preservative material (Tectyl)
* External salt source (e.g. ocean spray)

J

Most likely sources:
* Valve rocker bushings
* Piston pin bushings
* Camshaft thrust bearings
* Crankshaft thrust bearings
* Lube oil pump bearings
* Governor drive bushings
* Main or rod bearings[3]

K

Most likely sources:
*Main bearing overlay[3]
*Conn rod bearing overlay[3]
[3]Pb should also be present

L

Most likely sources:
*Foreign material to the engine - usually from airborne dirt. Check/ change air filters; inspect air box and turbo boot for leaks. Wear metals could also be present.
* Can appear with Aluminum either as airborne dirt or as piston skirt material
*Oil filter bypassing (EMD) or attempts to extend oil life.
*Silicone based RTV or seals.

M

Most likely sources:
*Foreign material to the engine - usually from rubber compounds (seals and hoses).
*Certain oil additives
*Foreign oil. Check Phosphorus level

N

Most likely sources:
*EMD engines only. If reported on a a GE unit, oil samples may have been mixed up.
*Piston wrist pin (EMD only)
*Turbo bearing (EMD only)

Figure 6

Unit Predicted to Reach Predetermined Level at day 65 and thus will not reach day 92 – Solution: Maintain at day 65

| Y | X |
|---|---|
| 1.3143 | 0 |
| 1.5228 | 5 |
| 1.7313 | 10 |
| 1.9398 | 15 |
| 2.1483 | 20 |
| 2.3568 | 25 |
| 2.5653 | 30 |
| 2.7738 | 35 |
| 2.9823 | 40 |
| 3.1908 | 45 |
| 3.3993 | 50 |
| 3.6078 | 55 |
| 3.8163 | 60 |
| **4.0248** | **65** |
| 4.2333 | 70 |

Unit Predicted to Reach Predetermined Level at day 105 and Thus will not reach day 184 – Solution: Maintain at day 92

| Y | X |
|---|---|
| 0.6641 | 0 |
| 0.9831 | 10 |
| 1.3021 | 20 |
| 1.6211 | 30 |
| 1.9401 | 40 |
| 2.2591 | 50 |
| 2.5781 | 60 |
| 2.8971 | 70 |
| 3.2161 | 80 |
| 3.5351 | 90 |
| 3.8541 | 100 |
| 3.9498 | 103 |
| **4.0136** | **105** |
| 4.1731 | 110 |

Trend for Locomotive A Exhibits Increasing Metal Concentration
Solution: Monitor – Action May be Required Trend for Locomotive B Exhibits Metal Concentration within Limits
Solution: No Action Required

METHOD FOR SERVICING A VEHICLE

RELATED APPLICATIONS

This application claims the benefit of U.S. Provisional Patent Application No. 60/785,225 filed Mar. 22, 2006, the contents of which is incorporated by reference herein in its entirety.

FIELD OF THE INVENTION

The present invention relates generally to a method for servicing a vehicle and more particularly to a method for generating trend data to more efficiently and cost effectively service a vehicle.

BACKGROUND OF THE INVENTION

In an attempt to ensure the proper operation of locomotives in the railroad fleet, the United States government has mandated that active locomotives undergo inspections at maximum intervals of 92 days. As a result of this mandate and in order to minimize the downtime of active locomotives, the routine maintenance of these locomotives are typically scheduled to evolve around this 92-day inspection cycle. For example, the engine oil and filters are routinely drained or changed every 92 or 184 days and oil specimens are sent to an outside laboratory for analysis. The resultant data from this analysis is entered into an operations database, wherein the operations database includes the results of previously analyzed specimens. A field service engineer then reviews and evaluates the data to determine if the data exceeds established parameters. If any limits are exceeded, the field service engineer takes the prescribed action responsive to the limit(s) exceeded. Unfortunately however, the current approach toward maintaining these locomotives includes several undesirable limitations.

One such limitation involves the inability to effectively diagnose some existing problems that may initially represent themselves as analytical values approach a predefined limit. For example, consider the situation where a problem exists but is not severe enough at the time the oil sample is taken to cause oil analysis values to exceed established limits. When the field service engineer is evaluating the resultant data from the laboratory analysis to determine whether any corrective action is required for a particular locomotive, proportionate corrective action will be decided upon in a manner responsive only to those values that have exceeded the prescribed limits. For oil analysis data that fall within the prescribed limits, the field service engineer does not perform or recommend a corrective action. Thus, the problem would not be detected until the locomotive has exceeded a prescribed limit or until the next scheduled maintenance occurs.

Another limitation involves the inability to identify possible pending anomalies. For example, consider the situation where a problem does not yet exist, but is becoming more probable due to the age or operating environment of the locomotive. Because the oil analysis data being reviewed by the field service engineer is most responsive only to the most recently drawn oil sample, the data offers little or no information pertaining to the condition of the oil drained from the same unit during previous maintenance. Information pertaining to the prior performance of the locomotive is not factored into the field service engineer's consideration of the engine and engine oil condition. Thus, any degradation in operation of the locomotive prior to the most recent maintenance is typically not considered when corrective action is being contemplated. This is undesirable because some locomotives, such as older locomotives or locomotives that are operated in harsh environments may require more frequent maintenance. As above, the anomaly would not be detected until the locomotive has exceeded the limit or until the next scheduled maintenance occurs. Both of these issues act to increase the cost of maintaining the locomotive and to decrease the life expectancy of the locomotive.

SUMMARY OF THE INVENTION

A method for monitoring at least one characteristic of an engine is provided, wherein the method includes generating a data set that includes data responsive to the at least one characteristic. The method further includes comparing the data set against predetermined parametric data and creating trend data for a plurality of the data sets. Furthermore, the method includes analyzing the trend data to determine if action should be taken regarding the engine.

Furthermore, a system for monitoring at least one characteristic of an engine is provided and includes an input device for receiving data responsive to the at least one characteristic, wherein the data is associated with the engine and generated by analyzing at least one component of the engine. Moreover, a storage device for storing the data for a plurality of receiving events and a data processing device for processing at least a portion of the data to generate trend data is also provided.

Moreover, a method for monitoring at least one characteristic of a vehicle is provided and includes generating a data set, wherein the data set includes data responsive to the at least one vehicle characteristic. The method also includes comparing the data set against predetermined parametric data, creating trend data for a plurality of the data sets and analyzing the trend data to determine if action should be taken regarding the vehicle.

BRIEF DESCRIPTION OF THE FIGURES

The foregoing and other features and advantages of the present invention will be more fully understood from the following detailed description of illustrative embodiments, taken in conjunction with the accompanying drawings in which like elements are numbered alike in the several Figures:

FIG. 6 is a chart identifying possible causes for a locomotive engine exceeding a predetermined parameter of the method of FIG. 2;

DETAILED DESCRIPTION

Figure 1:
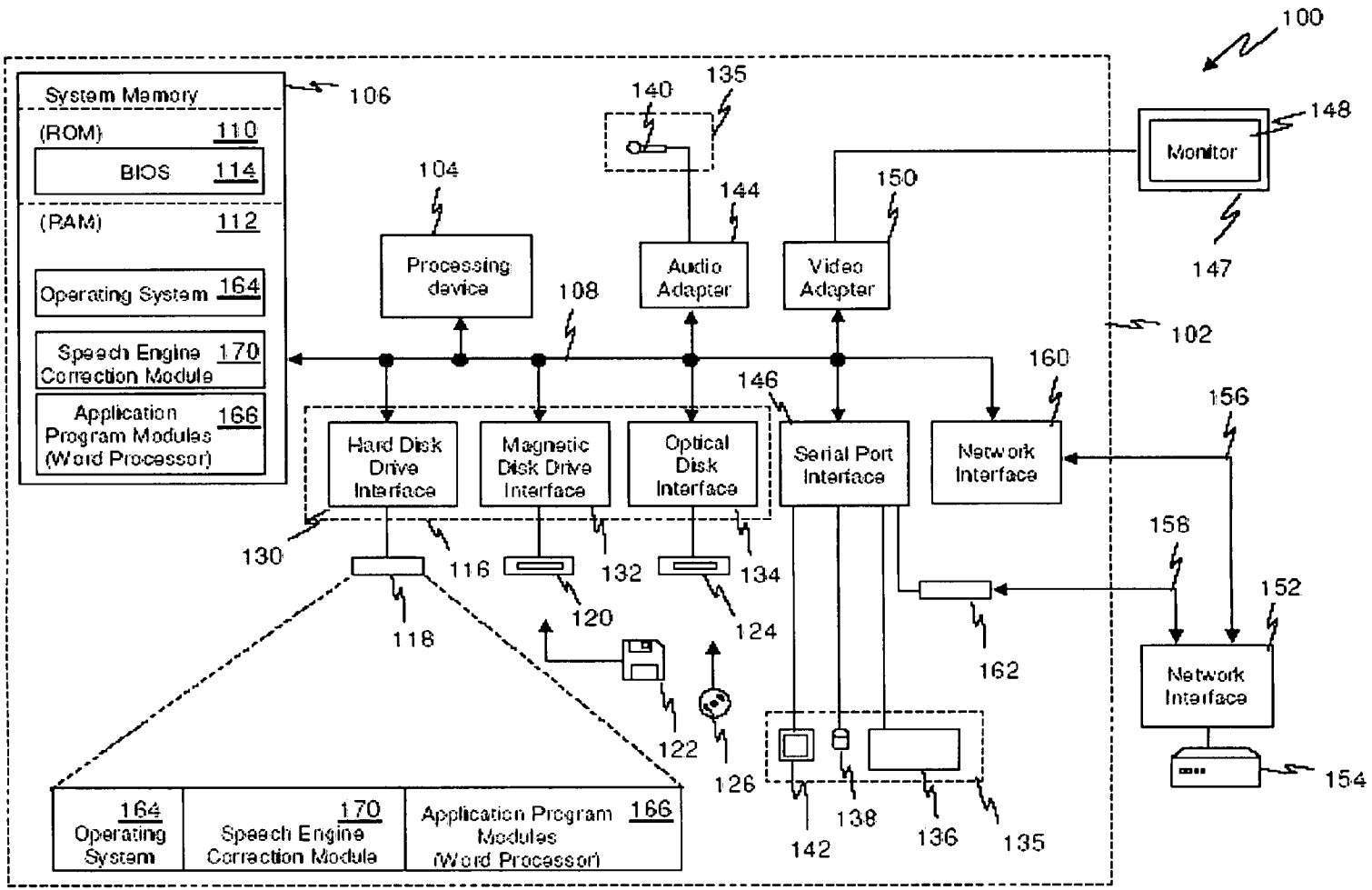
FIG. 1 is a schematic block diagram illustrating one embodiment of a system for implementing the method of the present invention.

The present invention provides a method for monitoring the operational health of an engine by analyzing engine fluid specimens and developing trend data to be used for predictive analysis. It should be appreciated that although this method is discussed herein with regards to analyzing a fluid of a locomotive engine, this method may be applied to any other type of engine and/or vehicle and may be performed with regards to analyzing a mechanical and/or an electrical characteristic of the engine. It is contemplated that such engines may include, but not be limited to, automobile engines, ship engines and aircraft engines.

As a general overview of current procedures with regards to the railroad industry, an oil specimen is typically collected from a locomotive engine at a predetermined frequency, such as every 7 to 10 days. Prior to sending the oil specimen out for analysis, oil specimen data is collected and logged, wherein the oil specimen data may include the locomotive from which the sample was collected, the date on which the sample was collected, the location from where the sample was collected and any other desired information regarding the oil sample. The specimen may then be sent out to an oil-testing laboratory for analysis to determine the chemical properties of the oil (e.g. such as alkalinity, oxidation, nitration), the physical properties of the oil (e.g. viscosity, presence of wear metals) and whether the oil was contaminated (e.g. fuel leak, water leak, wear metals). The results of the analytical tests are then entered into a central location database and evaluated against predetermined parameters (minimums or maximums). If a parameter is exceeded, one or more defect flags are communicated to a field service engineer with a recommended action for each defect flag and the locomotive is given a scheduled date for service. If it is determined that further troubleshooting is required to solve the problem, then additional tests could be scheduled before the unit arrives for servicing. As such, any needed parts may be order and on site before the locomotive arrives in the service center.

It should be appreciated that the method of the present invention allows the obtained information pertaining to the servicing of the locomotive to be collected and stored in a central database, wherein the information may include past service dates, scheduled service dates and oil analysis data for each of the past service dates. This information may then be used to generate data for predictive analysis and preventive action. For example, the obtained data can be used to determine when the engine oil will exceed it useful life and if it is determined that the engine oil will exceed it useful life span between the 92 and 184 day service cycle of the locomotive, then a defect flag can be communicated to field service personnel indicating a requirement that the locomotive be service at the 92 day maintenance cycle.

As such, the method of the present invention provides for the establishment of trend lines which allow for a predictive and preventive approach to cost effectively maintain a safe locomotive fleet. For example, currently once a locomotive engine reaches 26,000 MWhr, it is scheduled for an engine overhaul (typically 4 to 8 years and varies from railroad to railroad, different duty cycles, etc.). If a railroad has 100 locomotives due in for overhaul there is currently no system to determine which locomotive has priority other then utilization. As such, a locomotive that is in good condition could be overhauled before a locomotive that has started experiencing a bearing failure, possibly resulting in a crankcase failure in service because it was not overhaul when needed. The trend line approach is able to assist in determining the priority in which locomotives should be overhauled. Thus, a changing trend line is used to select which engine should be overhaul first based not only on utilization (MWHr) but also on which locomotive engine has the most engine wear.

Referring to FIG. 1, a block diagram illustrating one embodiment of a system 100 for implementing a method for monitoring at least one characteristic of an engine is shown and may include a general computer system 102, including a processing device 104, a system memory 106, and a system bus 108, wherein the system bus 108 couples the system memory 106 to the processing device 104. The system memory 106 may include read only memory (ROM) 110 and random access memory (RAM) 112. A basic input/output system 114 (BIOS), containing basic routines that help to transfer information between elements within the general computer system 102, such as during start-up, is stored in ROM 110. The general computer system 102 may further include a storage device 116, such as a hard disk drive 118, a magnetic disk drive 120, e.g., to read from or write to a removable magnetic disk 122, and an optical disk drive 124, e.g., for reading a CD-ROM disk 126 or to read from or write to other optical media. The storage device 116 may be connected to the system bus 108 by a storage device interface, such as a hard disk drive interface 130, a magnetic disk drive interface 132 and an optical drive interface 134. The drives and their associated computer-readable media provide non-volatile storage for the general computer system 102. Although the description of computer-readable media above refers to a hard disk, a removable magnetic disk and a CD-ROM disk, it should be appreciated that other types of media that are readable by a computer system and that are suitable to the desired end purpose may be used, such as magnetic cassettes, flash memory cards, digital video disks, Bernoulli cartridges, and the like.

A user may enter commands and information into the general computer system 102 through a conventional input device 135, including a keyboard 136, a pointing device, such as a mouse 138 and a microphone 140, wherein the microphone 140 may be used to enter audio input, such as speech, into the general computer system 102. Additionally, a user may enter graphical information, such as a drawing or hand writing, into the general computer system 102 by drawing the graphical information on a writing tablet 142 using a stylus. Furthermore, the user may enter information into the general computer system 102 by first entering the information into a secondary device, such as a PDA, a Pocket PC and/or laptop computing device and then transferring the information into the general computer system 102. The general computer system 102 may also include additional input devices suitable to the desired end purpose, such as a joystick, game pad, satellite dish, scanner, or the like. The microphone 140 may be connected to the processing device 104 through an audio adapter 144 that is coupled to the system bus 108. Moreover, the other input devices are often connected to the processing device 104 through a serial port interface 146 that is coupled to the system bus 108, but may also be connected by other interfaces, such as a parallel port interface, a game port or a universal serial bus (USB).

A display device 147, such as a monitor or other type of display device 147, having a display screen 148, is also connected to the system bus 108 via an interface, such as a video adapter 150. In addition to the display screen 148, the general computer system 102 may also typically include other peripheral output devices, such as speakers and/or printers. The general computer system 102 may operate as a standalone system or in a networked environment using logical connections to one or more remote computer systems 152. The remote computer system 152 may be a server, a router, a peer device or other common network node, and may include any or all of the elements described relative to the general computer system 102, although only a remote memory storage device 154 has been illustrated in FIG. 1. The logical connections as shown in FIG. 1 include a local area network (LAN) 256 and a wide area network (WAN) 258. Such networking environments are commonplace in offices, enterprise-wide computer networks, intranets and the Internet.

When used in a LAN networking environment, the general computer system 102 is connected to the LAN 156 through a network interface 160. When used in a WAN networking environment, the general computer system 102 typically includes a modem 162 or other means for establishing communications over a WAN 158, such as the Internet. The modem 162, which may be internal or external, may be connected to the system bus 108 via the serial port interface 146. In a networked environment, program modules depicted relative to the general computer system 102, or portions thereof, may be stored in the remote memory storage device 154. It should be appreciated that the network connections shown are exemplary and other means of establishing a communications link between the computer systems may be used. It should also be appreciated that the application module could equivalently be implemented on host or server computer systems other than general computer systems, and could equivalently be transmitted to the host computer system by means other than a CD-ROM, for example, by way of the network connection interface 160.

Furthermore, a number of program modules may be stored in the drives and RAM 112 of the general computer system 102. Program modules control how the general computer system 102 functions and interacts with the user, with I/O devices or with other computers. Program modules include routines, operating systems 164, target application program modules 166, data structures, browsers, and other software or firmware components. The method of the present invention may be included in an application module and the application module may conveniently be implemented in one or more program modules based upon the methods described herein. The target application program modules 166 may comprise a variety of applications used in conjunction with the present invention.

It should be appreciated that no particular programming language is described for carrying out the various procedures described in the detailed description because it is considered that the operations, steps, and procedures described and illustrated in the accompanying drawings are sufficiently disclosed to permit one of ordinary skill in the art to practice an exemplary embodiment of the present invention. Moreover, there are many computers and operating systems that may be used in practicing an exemplary embodiment, and therefore no detailed computer program could be provided which would be applicable to all of these many different systems. Each user of a particular computer will be aware of the language and tools which are most useful for that user's needs and purposes.

Figure 2:
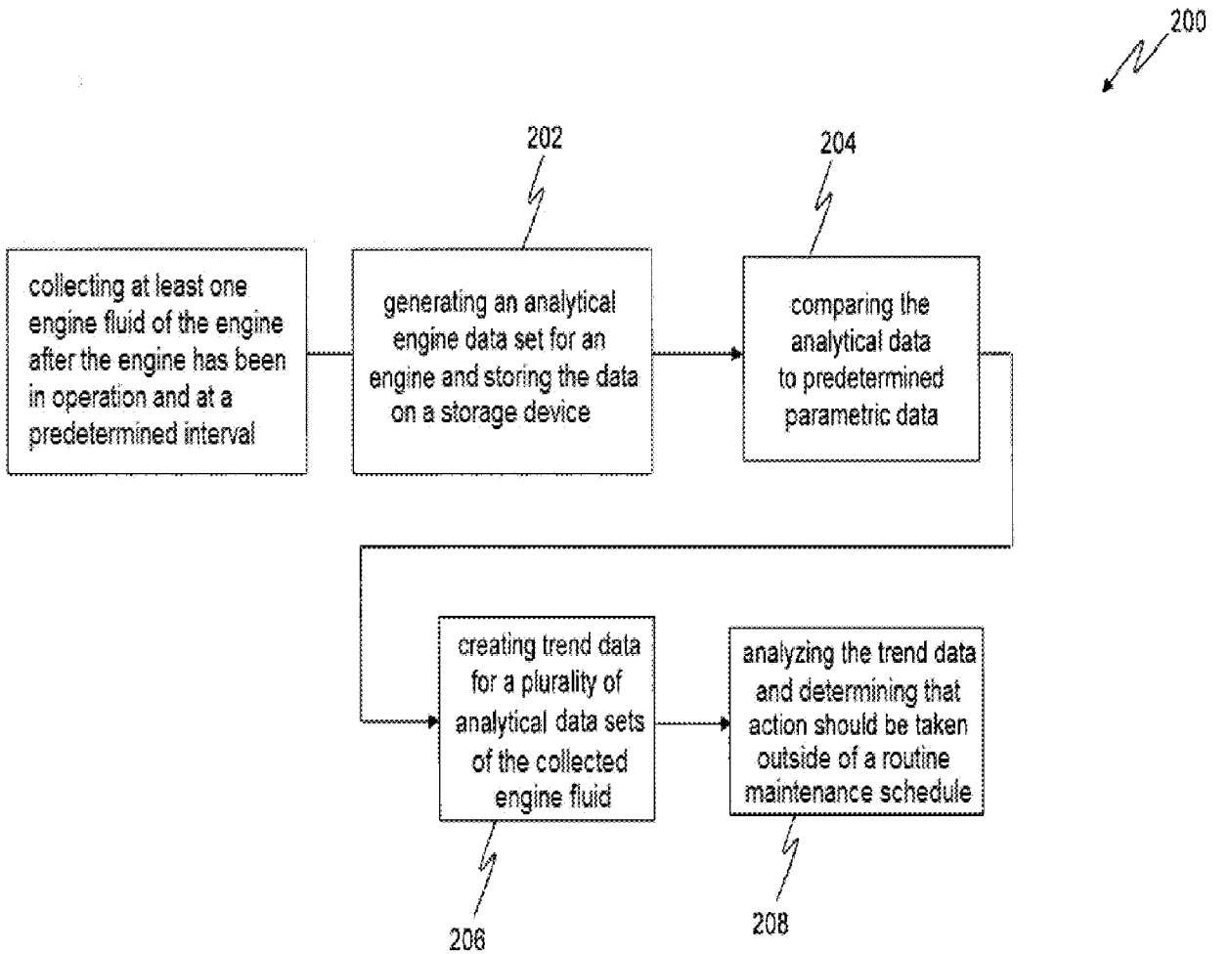
FIG. 2 is a block diagram illustrating an overall method for maintaining the operational health of a locomotive engine, in accordance with the present invention.
Figure 3:
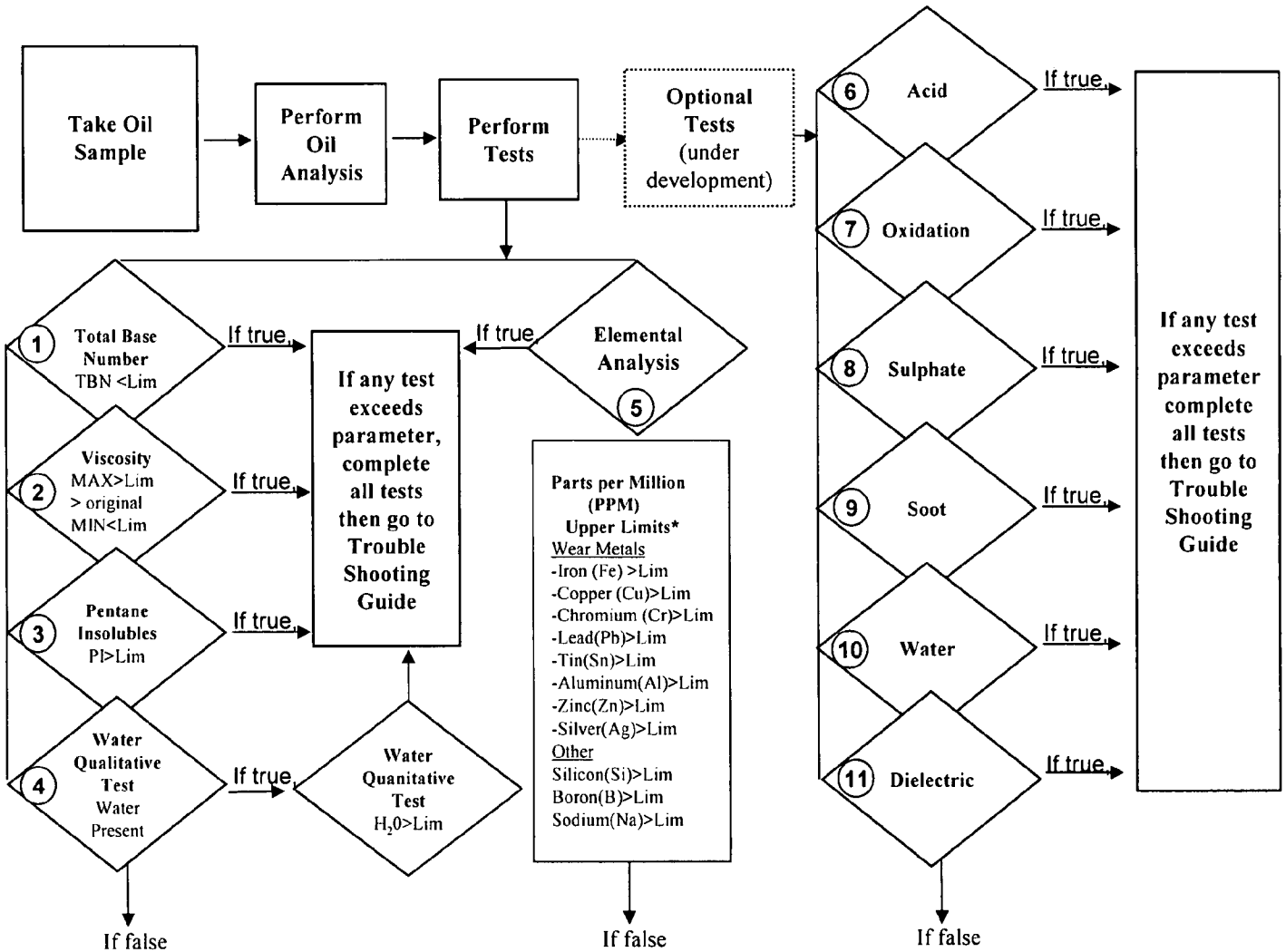
FIG. 3 is a block diagram illustrating one embodiment of a portion of the method of FIG. 2.
Figure 4:
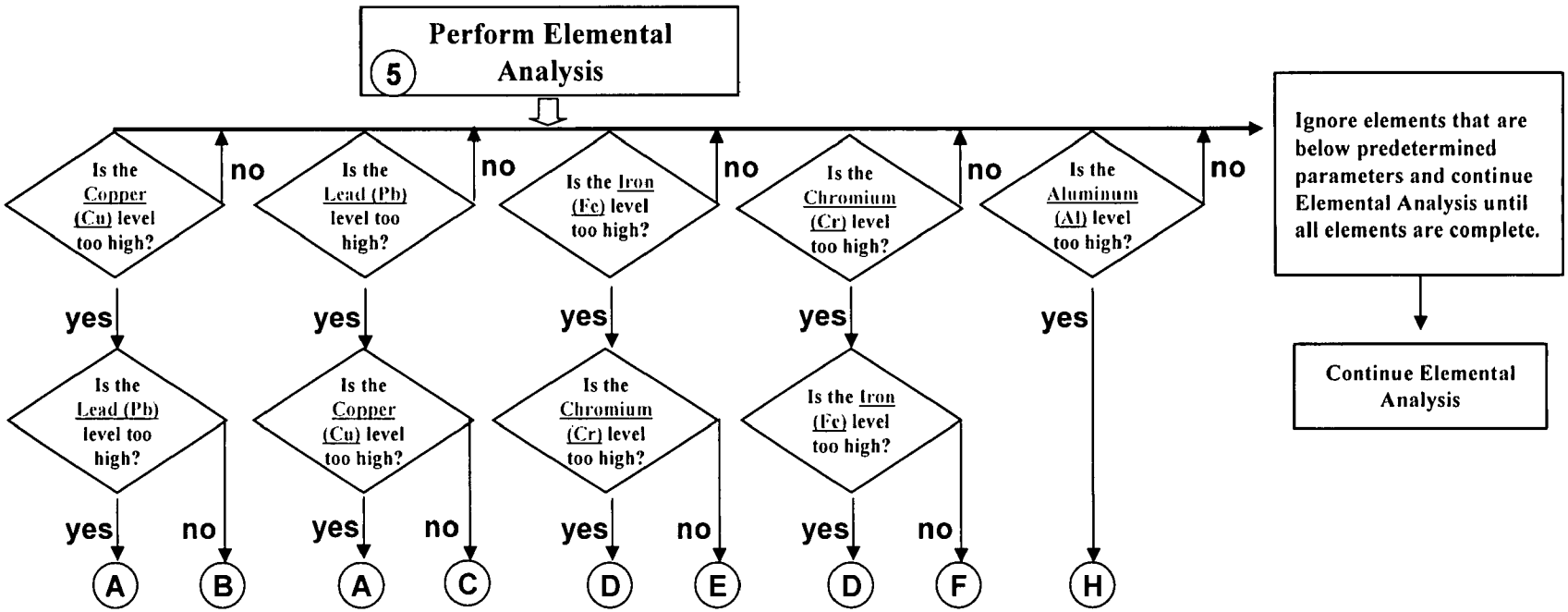
FIG. 4 is a block diagram illustrating one embodiment of a portion of the method of FIG. 3.
Figure 5:
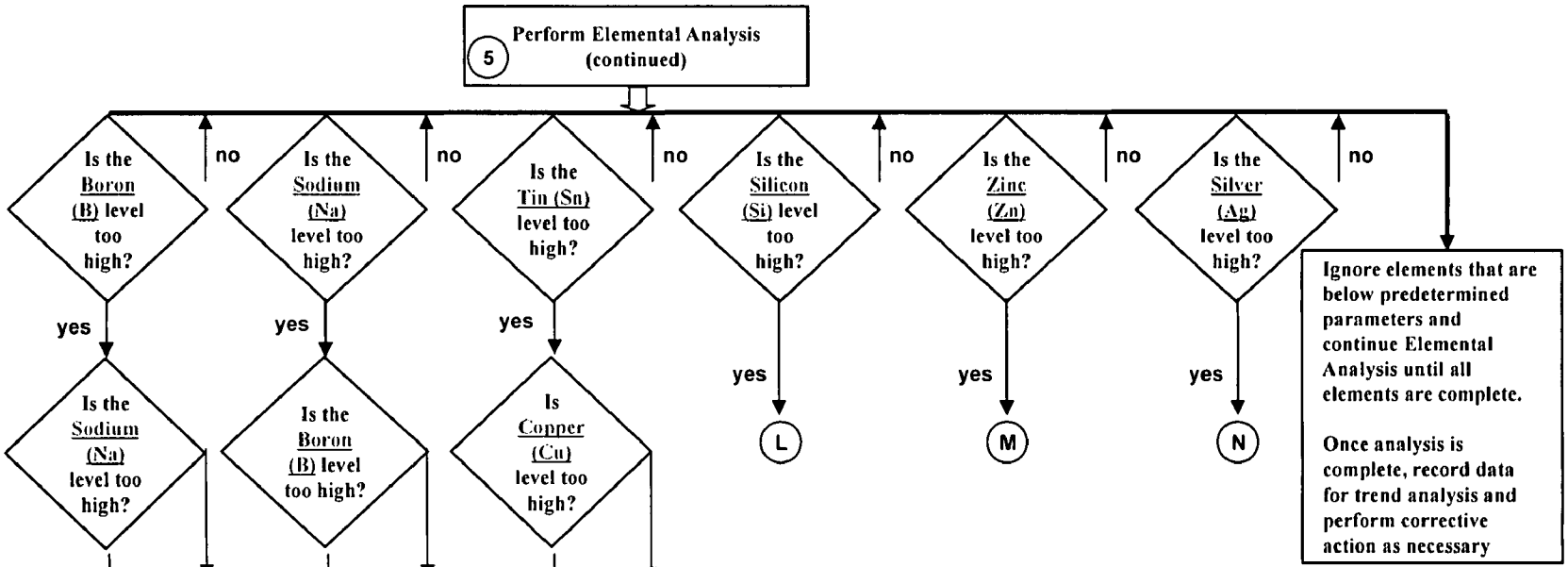
FIG. 5 is a block diagram that is a continuation of FIG. 4.

Referring to FIG. 2, an overall block diagram illustrating a method 200 for monitoring the operational health of an engine is shown and includes generating analytical engine data for an engine, as shown in operational block 202. Referring to FIGS. 3-6, this may be accomplished by collecting an oil specimen from the engine at a predetermined frequency, such as every 7 to 10 days in the case of a locomotive engine, and analyzing the oil specimen to identify the chemical properties of the oil (e.g. such as alkalinity, oxidation, nitration), the physical properties of the oil (e.g. viscosity, presence of wear metals) and/or whether the oil has been contaminated (e.g. fuel leak, water leak, wear metals).

It should be appreciated that prior to sending the oil specimen out for analysis, oil specimen data may be collected and logged, wherein the oil specimen data may include the vehicle from which the sample was collected, the date on which the sample was collected, the location from where the sample was collected and any other desired information regarding the oil sample. The specimen may then be analyzed or sent out to an oil-testing laboratory for analysis to determine the chemical properties of the oil (e.g. such as alkalinity, oxidation, nitration), the physical properties of the oil (e.g. viscosity, presence of wear metals) and whether the oil was contaminated (e.g. fuel leak, water leak, wear metals) as discussed in more detail hereinafter. The results of the analytical engine data and the correlating oil specimen data may then be entered into a central location database. It should be appreciated that the central database may contain additional information on each locomotive, such as maintenance history, scheduled inspection, scheduled replacements of consumables such as engine oil, oil filters, fuel filter and air filters, as well as any unscheduled maintenance operations.

Once the engine fluid has been obtained, the engine fluid analysis may be conducted to determine if the engine fluids exceed predetermined limits for desired characteristics, such as Total Base Number, Viscosity Levels, Pentane Insoluble Levels and Water Qualitative Levels. It is contemplated that the action taken may be responsive to the predetermine level (s) that have been exceeded. For example, one reason that the Total Base Number may exceed the predetermined limit may be that the oil wasn't changed at the proper interval. Another reason may be due to worn engine rings or a worn cylinder liner. As such, if the Total Base Number limit has been exceeded, then the suggested corrective action may involve checking the compression, checking the engine oil for a high presence of bearing metals and/or maintaining proper engine oil change intervals. As another example, consider the case where the Pentane Insoluble level exceeded a predetermine limit. This may be caused by either dirty oil (usually due to a plugged filter or to improper oil change intervals) or to a condition called fuel soot blow-by. As such, if the Pentane Insoluble level limit has been exceeded, then the suggested corrective action may involve checking for worn or broken piston rings, valve guides, turbine seals or other engine wear components and/or maintaining proper engine oil change intervals. Moreover, the first action taken may be based upon a review of the performance and/or service history of the locomotive.

The analytical engine data may then be compared and evaluated against predetermined parameters (such as minimums and/or maximums parameters), as shown in operational block 204. If a predetermined parameter has been exceeded, a defect flag or work order may be generated and communicated to the field service personnel to inform the field service personnel that one or more limits have been exceeded. The vehicle may then be scheduled for servicing responsive to the particular limit(s) exceeded, wherein the vehicle will typically not be released until the required work task has been completed and the field service engineer has electronically signed off on the work task as being completed. If no predetermined limit has been exceeded, then the normal servicing schedule for the engine may be followed. When data sets (i.e. analytical engine data and/or vehicle information) have been generated for at least three (3) different engine fluid samples (possibly two (2)), trend data is created for the data sets, as shown in operational block 206.

Although this may be accomplished by using the analytical engine data sets to calculate a trend line or line of best-fit using regression analysis techniques it should be appreciated that addition statistical methods may also be applied. As shown in operational block 208, the trend data is then analyzed to determine what action should be taken on the vehicle. This may be accomplished by applying the trend data to an algorithm to determine what action should be taken on the vehicle, such as when the engine oil will exceed it useful life. This allows for the determination of whether the engine oil will still be in satisfactory condition up to the time of its scheduled maintenance. If the engine oil condition will be beyond its useful life before its scheduled normal maintenance, the vehicle would be scheduled for servicing before the useful life of the oil is exceeded.

Figure 7:
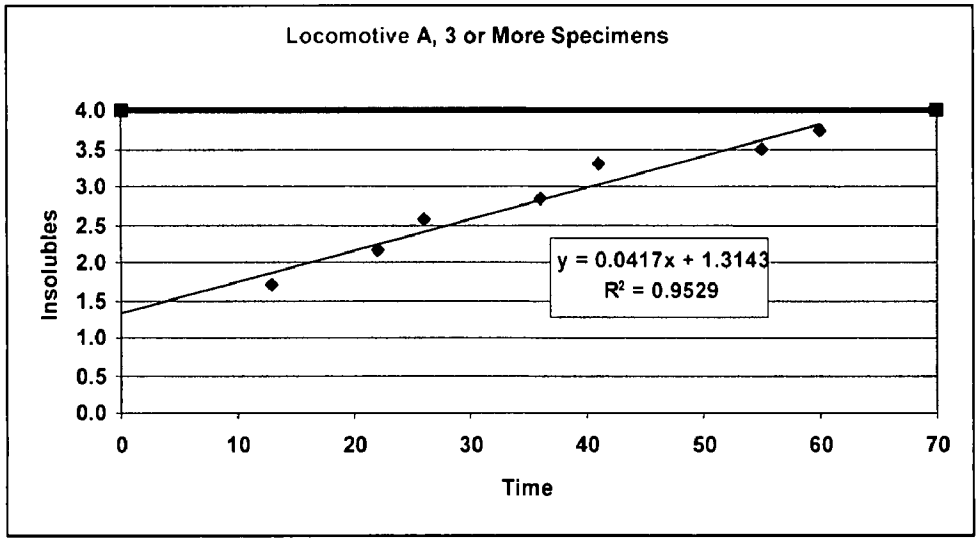
FIG. 7 is a first example of a trend line generated using the method of FIG. 2.
Figure 8:
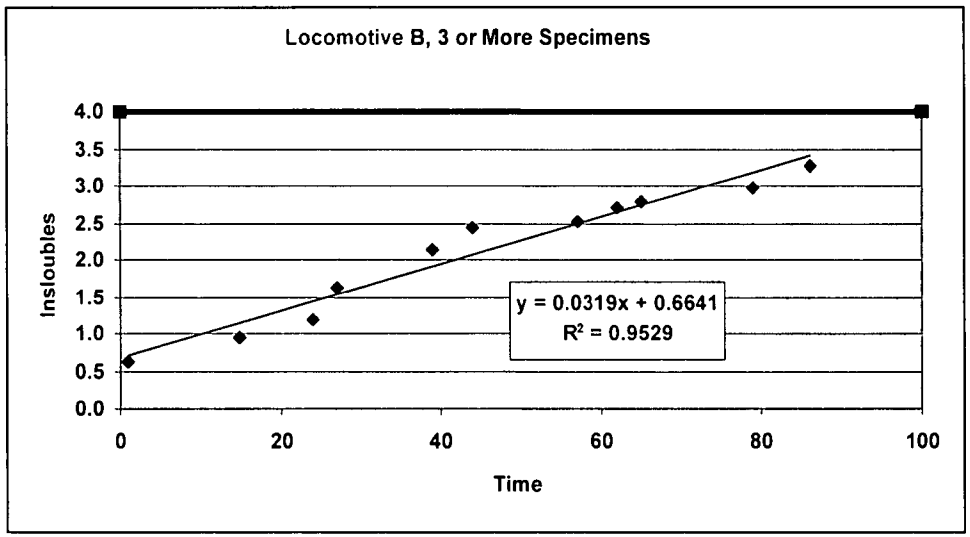
FIG. 8 is a second example of a trend line generated using the method of FIG. 2.

For example, referring to FIG. 7 consider the situation where the trend data predicts that the Pentane Insoluble level for a particular vehicle engine will exceed a predetermined Pentane Insoluble level limit on the $65^{th}$ day into its 92-day maintenance cycle. As such, because the engine will not last until its normal 92-day maintenance cycle, the vehicle may be scheduled for servicing prior to or on the $65^{th}$ day. If the vehicle is allowed to go without servicing beyond that day, then the engine may experience poor performance, increased wear and/or damage. As another example, referring to FIG. 8 consider the situation where the trend data predicts that the Pentane Insoluble level for a particular vehicle engine will exceed a predetermined Pentane Insoluble level limit on the $105^{th}$ day into its 184-day maintenance cycle. As above, because the engine will not last until its normal 182-day maintenance cycle, the locomotive may be scheduled for servicing prior to or on the $105^{th}$ day. If the vehicle is allowed to go without servicing beyond that day, then the engine may experience poor performance, increased wear and/or damage.

Figure 9:
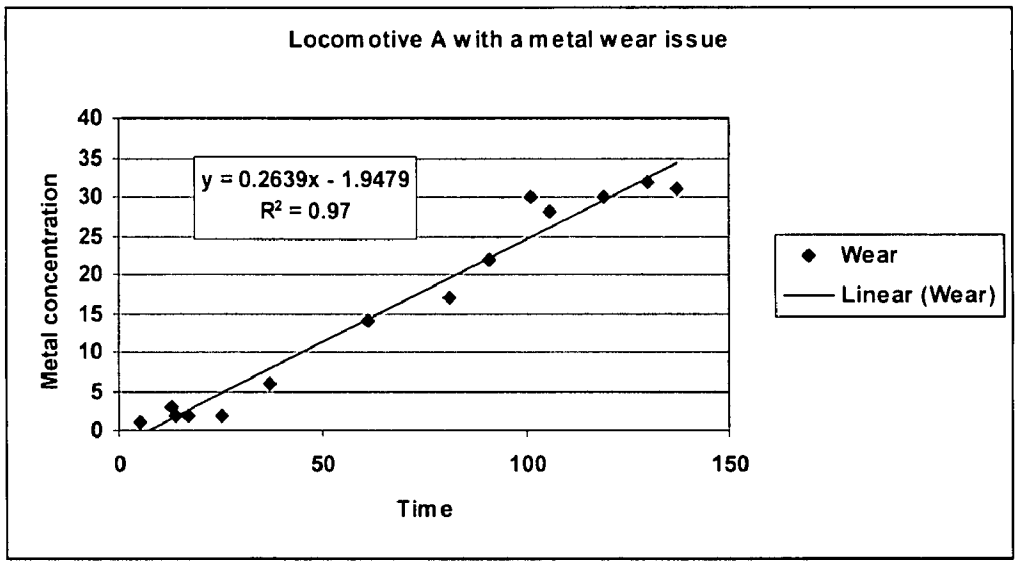
FIG. 9 is a third example of a trend line generated using the method of FIG. 2.
Figure 10:
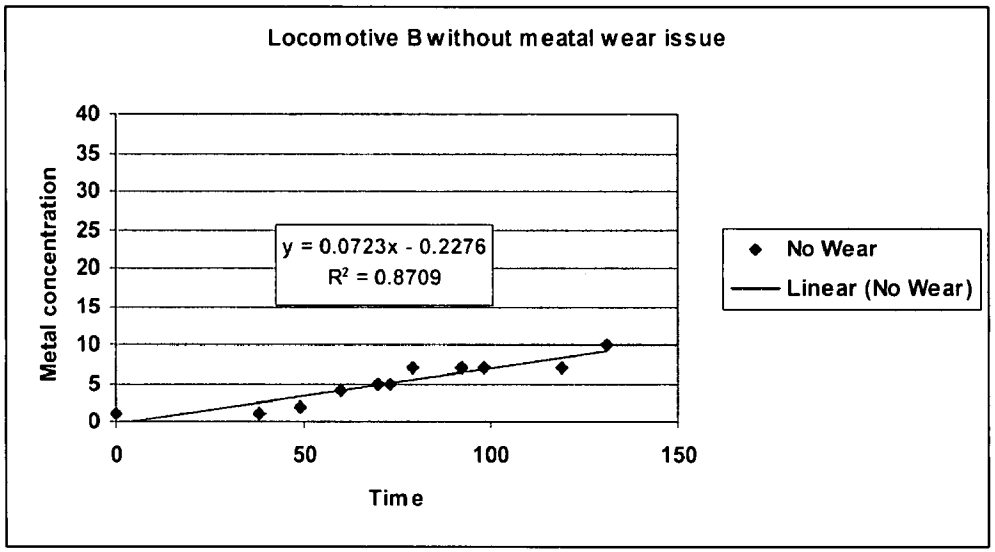
FIG. 10 is a fourth example of a trend line generated using the method of FIG. 2.

As another example, referring to FIG. 9 consider the situation where sampling indicates increasing metal wear for a particular vehicle. Depending upon the levels and/or types of wear metal(s) detected, the vehicle may be allowed to continue operating until its normal service schedule or the vehicle may be directed for immediate servicing. If the metal concentration is within prescribed limits, as shown by example in FIG. 10, then no corrective action may be required.

It should be appreciated that data responsive to the engine oil analysis can be stored to develop a database of oil historical data, wherein the oil historical data may include raw data, such as the analytical engine data and/or locomotive information, and processed data, such as the regression analysis data and/or algorithm data. The oil historical data may then be examined to develop an overhaul priority list to ensure that the vehicle engines that need to be overhauled have priority over vehicle engines that can wait for overhaul. This may be accomplished by examining the regression analysis for each analytical engine data set paying attention to the slope, which changes in response to the ring liner zone, i.e. the useful life of the engine oil. Responsive to the changing slopes of the regression analysis, the vehicle engine which has the greatest or most urgent need for an overhaul can be determined.

It should be further appreciated that the method 200 of FIG. 2 may also be applied to other vehicle components in addition to vehicle engines. For example, the method 200 may be used to perform a predictive analysis on mechanical and/or electrical systems of a vehicle, such as predicting brake wear for a locomotive. Moreover, it should be appreciated that the method 200 of FIG. 2 may be used to perform a predictive analysis on other types of vehicles such as aircraft (i.e. aircraft engines, airframe components, etc) and/or ships.

In accordance with an exemplary embodiment, the processing of FIG. 2 may be implemented by a controller operating in response to a computer program. In order to perform the prescribed functions and desired processing, as well as the computations therefore (e.g. execution control algorithm(s), the control processes prescribed herein, and the like), the controller may include, but not be limited to, a processor(s), computer(s), memory, storage, register(s), timing, interrupt (s), communication interface(s), and input/output signal interface(s), as well as combination comprising at least one of the foregoing.

Additionally, the invention may be embodied in the form of a computer or controller implemented processes. The invention may also be embodied in the form of computer program code containing instructions embodied in tangible media, such as floppy diskettes, CD-ROMs, hard drives, and/or any other computer-readable medium, wherein when the computer program code is loaded into and executed by a computer or controller, the computer or controller becomes an apparatus for practicing the invention. The invention can also be embodied in the form of computer program code, for example, whether stored in a storage medium, loaded into and/or executed by a computer or controller, or transmitted over some transmission medium, such as over electrical wiring or cabling, through fiber optics, or via electromagnetic radiation, wherein when the computer program code is loaded into and executed by a computer or a controller, the computer or controller becomes an apparatus for practicing the invention. When implemented on a general-purpose microprocessor the computer program code segments may configure the microprocessor to create specific logic circuits.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A method for monitoring at least one characteristic of a particular engine, the method comprising:

generating a data set wherein said data set includes data responsive to the at least one characteristic, said data generated by collecting at least one engine fluid of the engine after the engine has been in operation and at a predetermined interval, and analyzing said engine fluid;

storing said data on a storage device;

comparing said data set against predetermined parametric data;

creating trend line data with a slope by a computer processor for the particular engine for a plurality of said data sets of the collected engine fluid of that engine; and analyzing said trend line data with the slope by the computer processor . . . based on said trend line data with the slope outside of a routine maintenance schedule.

2. The method according to claim 1, wherein said generating further includes an elemental analysis of said engine fluid to generate data responsive to at least two or more of Iron, Copper, Chromium, Lead, Tin, Aluminum, Zinc, Silver, Silicon, Boron and/or Sodium.

3. The method according to claim 1, wherein said data set includes at least one data element and wherein said generating includes generating a historical data set by storing at least one data element and said data set for a plurality of sampling intervals.

4. The method according to claim 1, wherein said predetermined parametric data includes a predetermined parametric data range and wherein said comparing includes comparing said data set with said predetermined parametric data to determine whether said data is within said predetermined parametric data range.

5. The method according to claim 4, further comprising servicing the engine responsive to whether said data set is within said predetermined data range.

6. The method according to claim 1, wherein said creating further includes processing said data set to generate a trend line.

7. The method according to claim 6, wherein said creating analyzing includes analyzing at least one of said trend data and said trend line to predict whether future data sets will fall within a predetermined parametric data range.

8. The method according to claim 6, wherein said analyzing further includes analyzing the slope of said trend line to predict whether future data sets will fall within a predetermined parametric data range.

9. The method according to claim 1, further comprising at least me of servicing and maintaining at least a portion of the engine responsive to said analyzing.

10. The method according to claim 1, wherein said generating includes associating said data set with the engine.

11. A system for monitoring at least one characteristic of a particular engine, the system comprising:

an input device for receiving data responsive to the at least one characteristic, wherein said data is associated with that particular engine and generated by analyzing at least one fluid collected from said engine after the engine has been in operation and at a predetermined interval;

a storage device for storing said data for a plurality of receiving events; and a data processing device for processing at least a portion of said data to generate trend line data with a slope, and also for analyzing said trend line data with the slope . . . based on said trend line data with the slope outside of a routine maintenance schedule.

12. The system of claim 11, further comprising an output device for communicating said trend data.

13. The system of claim 11, wherein said processing device processes said data to generate a trend line responsive to said trend data.

14. The system of claim 13, wherein said processing device processes at least one of said trend data and said trend line to predict whether future data will fall within a predetermined parametric data range.

15. A method according to claim 2, wherein said elemental analysis further includes identifying possible causes for a locomotive engine exceeding said predetermined parametric data.

* * * * *